US011850615B2

(12) United States Patent
Logan

(10) Patent No.: US 11,850,615 B2
(45) Date of Patent: Dec. 26, 2023

(54) SYSTEM FOR TREATING A SURFACE AND COMPONENTS THEREOF

(71) Applicant: FORJAK Industrial, Inc., Columbus, OH (US)

(72) Inventor: Adam Garvey Logan, Pickerington, OH (US)

(73) Assignee: FORJAK Industrial, Inc., Columbus, OH (US)

( * ) Notice: Subject to any disclaimer, the term of this patent is extended or adjusted under 35 U.S.C. 154(b) by 461 days.

(21) Appl. No.: 16/676,908

(22) Filed: Nov. 7, 2019

(65) Prior Publication Data

US 2020/0122178 A1 Apr. 23, 2020

Related U.S. Application Data

(63) Continuation-in-part of application No. 16/538,171, filed on Aug. 12, 2019, now abandoned, which is a continuation of application No. 15/248,046, filed on Aug. 26, 2016, now Pat. No. 10,406,549.

(60) Provisional application No. 62/210,702, filed on Aug. 27, 2015.

(51) Int. Cl.

| | |
|---|---|
| ***B05B 13/00*** | (2006.01) |
| ***B05B 12/00*** | (2018.01) |
| ***B05B 9/00*** | (2006.01) |
| ***B05B 15/68*** | (2018.01) |
| ***B05B 15/628*** | (2018.01) |
| ***B05B 13/04*** | (2006.01) |
| *B05B 9/04* | (2006.01) |

(52) U.S. Cl.

CPC ..... *B05B 13/005* (2013.01); *B05B 9/007* (2013.01); *B05B 12/002* (2013.01); *B05B 13/04* (2013.01); *B05B 15/628* (2018.02); *B05B 15/68* (2018.02); *B05B 9/0423* (2013.01)

(58) Field of Classification Search

CPC . B05B 9/007; B05B 13/0405; B05B 13/0468; B05B 13/041; B05B 13/04; B05B 13/0431; B05B 13/005; B05B 15/628; B05B 15/68; B05B 12/002; B05B 12/00; B05B 9/01; B05B 15/656

USPC ..... 239/67, 69, 71, 73, 159–165, 172, 176, 239/280–281, 525, 536, 550, 551, 578, 239/750, 752; 118/305, 315, 323, 663; 74/104

See application file for complete search history.

(56) References Cited

U.S. PATENT DOCUMENTS

| | | | | |
|---|---|---|---|---|
| 2,365,755 A | | 12/1944 | Griffith | |
| 2,574,206 A | | 11/1951 | Browning | |
| 3,219,276 A | * | 11/1965 | Norris | B05B 13/0478 239/752 |
| 3,274,860 A | | 9/1966 | Gauthier et al. | |
| 3,592,387 A | | 7/1971 | Pilott et al. | |
| 4,762,013 A | | 8/1988 | Peter et al. | |

(Continued)

FOREIGN PATENT DOCUMENTS

JP 62-216667 A 9/1987

OTHER PUBLICATIONS

Ganey, Steven J.; Non-Final Office Action issued in U.S. Appl. No. 16/538,171; dated Jun. 8, 2021; 15 pages.

*Primary Examiner* — Steven J Ganey

(74) *Attorney, Agent, or Firm* — Frost Brown Todd LLP

(57) ABSTRACT

A system for treating a surface of a structure includes a wheeled vehicle that is movable along a surface and includes at least one surface treatment device.

3 Claims, 17 Drawing Sheets

(56) References Cited

U.S. PATENT DOCUMENTS

| | | | | |
|---|---|---|---|---|
| 5,346,140 | A | 9/1994 | Campbell | |
| 5,935,657 | A | 8/1999 | Melendez | |
| 8,726,833 | B2 | 5/2014 | Logan et al. | |
| 10,406,549 | B2 | 9/2019 | Logan | |
| 2006/0005765 | A1* | 1/2006 | Davidson | B05B 13/041 118/305 |
| 2013/0236644 | A1 | 9/2013 | Logan et al. | |
| 2014/0061429 | A1 | 3/2014 | Chen | |
| 2014/0220250 | A1 | 8/2014 | Logan et al. | |
| 2018/0093289 | A1* | 4/2018 | Raman | B05B 12/122 |

* cited by examiner

SYSTEM FOR TREATING A SURFACE AND COMPONENTS THEREOF

REFERENCE TO RELATED APPLICATIONS

This application is a continuation-in-part of U.S. patent application Ser. No. 16/538,171, entitled System for Treating a Surface, filed Aug. 12, 2019 which is a continuation of U.S. patent application Ser. No. 15/248,046, entitled System for Treating a Surface, filed Aug. 26, 2016, which claims priority to U.S. Provisional Patent Application Ser. No. 62/210,702, filed Aug. 27, 2015, and hereby incorporates these patent applications by reference herein in their respective entireties.

TECHNICAL FIELD

This application relates generally to treating a surface, and more particularly to a system for coating a surface of a structure.

BACKGROUND

Certain structures, such as interior walls, exterior walls, and/or ceilings of buildings, require periodic maintenance that includes painting. Known methods of painting such structures include manually preparing the structure for the application of paint using brushes and/or water spray nozzles, and then manually painting the structure, which is labor intensive.

SUMMARY

In accordance with one embodiment, a system for treating a surface is provided. The system comprises a wheeled cart, a lift structure, and a pump. The wheeled cart comprises a frame and a plurality of wheels rotatably coupled with the frame. The lift structure is coupled with the frame and comprises a mast, a carriage, a plurality of first spray heads, and a plurality of second spray heads. The carriage is slidably coupled with the mast and is movable between a raised position and a lowered position. The plurality of first spray heads are coupled with the carriage and are disposed on a right side of the wheeled cart. The plurality of second spray heads are coupled with the carriage and are disposed on a left side of the wheeled cart. The pump is in fluid communication with the plurality of first spray heads and the plurality of second spray heads and is configured to distribute a fluid to the plurality of first spray heads and the plurality of second spray heads.

In accordance with another embodiment, a system for treating a surface is provided. The system comprises a wheeled cart, a lift structure, and a supply unit. The wheeled cart comprises a frame and a plurality of wheels rotatably coupled with the frame. The lift structure is coupled with the frame and comprises a mast, a carriage, and a surface treatment device. The carriage is slidably coupled with the mast and is movable between a raised position and a lowered position. The surface treatment device is coupled with the carriage and is disposed on one or more of a right side and a left side of the wheeled cart. The supply unit is in communication with the surface treatment device and is configured to supply material to the surface treatment device.

In accordance with yet another embodiment, a system for treating a surface is provided. The system comprises a carriage, a plurality of spray heads, a pump, and a plurality of triggering mechanisms. The plurality of spray heads are coupled with the carriage. The pump is in fluid communication with the plurality of spray heads and is configured to distribute a fluid to the plurality of spray heads. The plurality of triggering mechanisms are each associated with one of the spray heads and configured to facilitate dispensation of paint therefrom. Each of the triggering mechanisms is operably coupled together to facilitate substantially simultaneous dispensation of paint from the spray heads.

BRIEF DESCRIPTION OF THE DRAWINGS

Various embodiments of a system and method for painting a structure will become better understood with regard to the following description, appended claims and accompanying drawings wherein:

DETAILED DESCRIPTION

Figure 1:
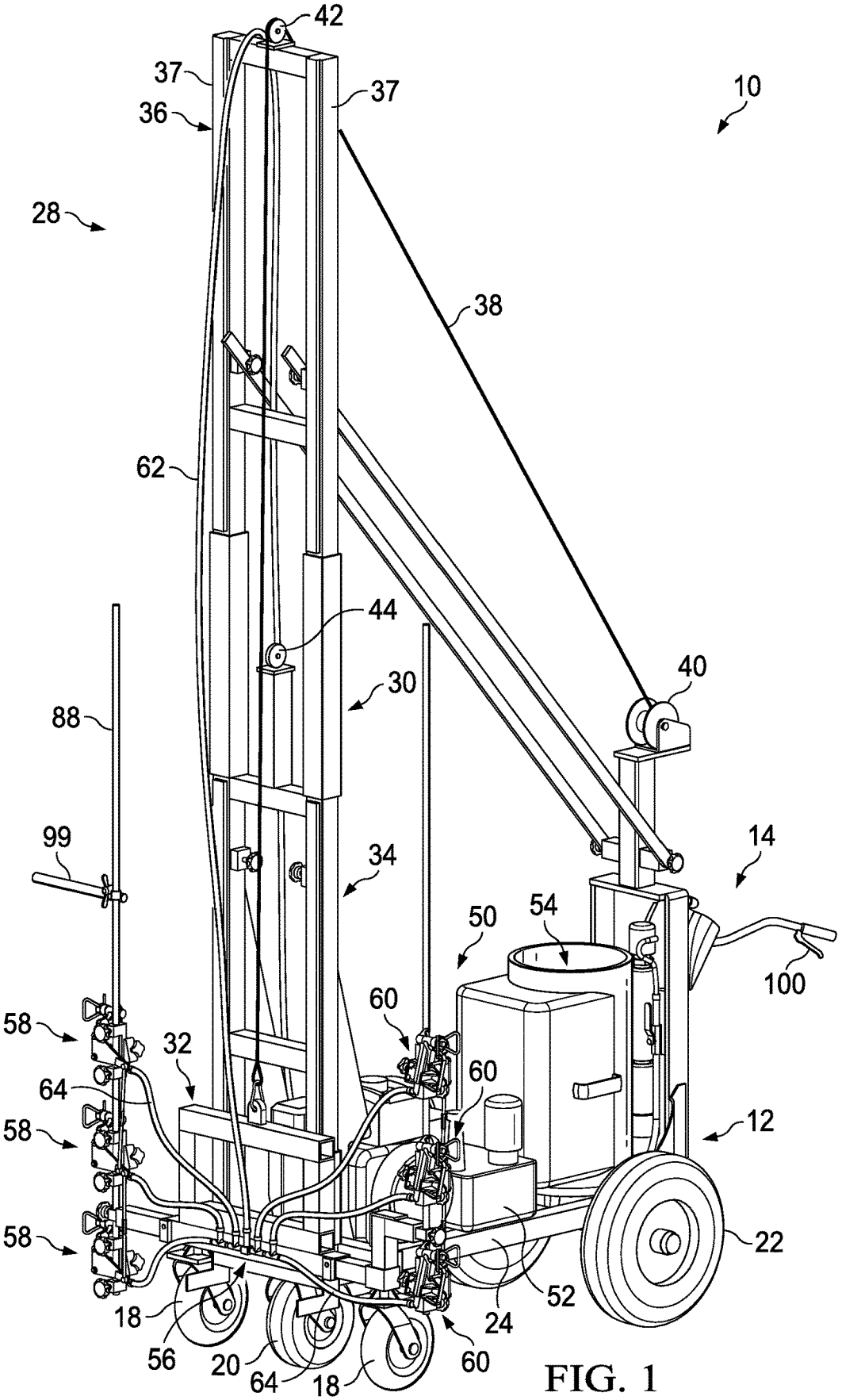
FIG. 1 is a perspective view depicting a system for painting a structure according to one embodiment, the system having a wheeled cart having a carriage.
Figure 2:
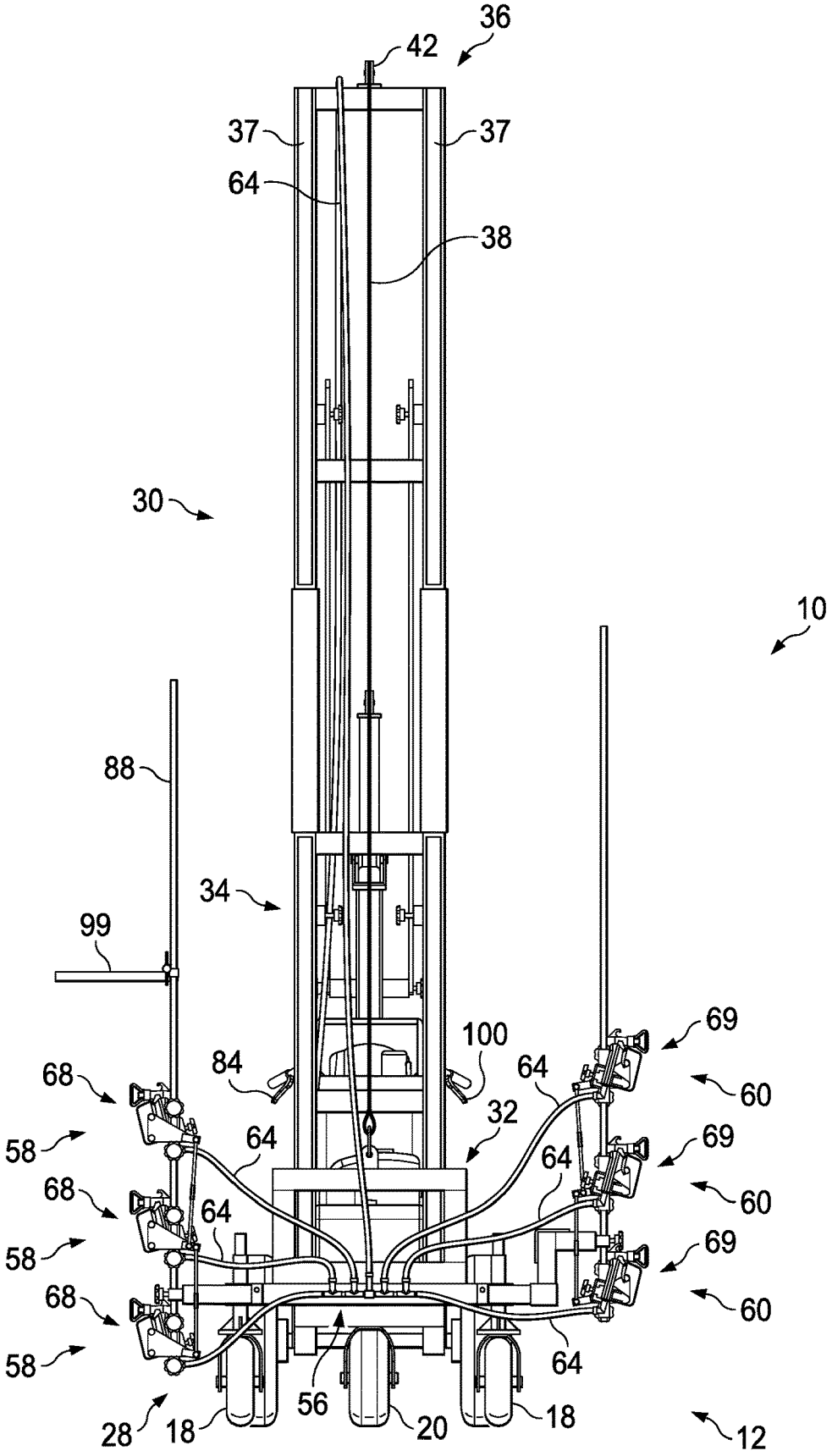
FIG. 2 is a front view depicting the wheeled cart of FIG. 1, wherein the carriage is shown in a lowered position.
Figure 3:
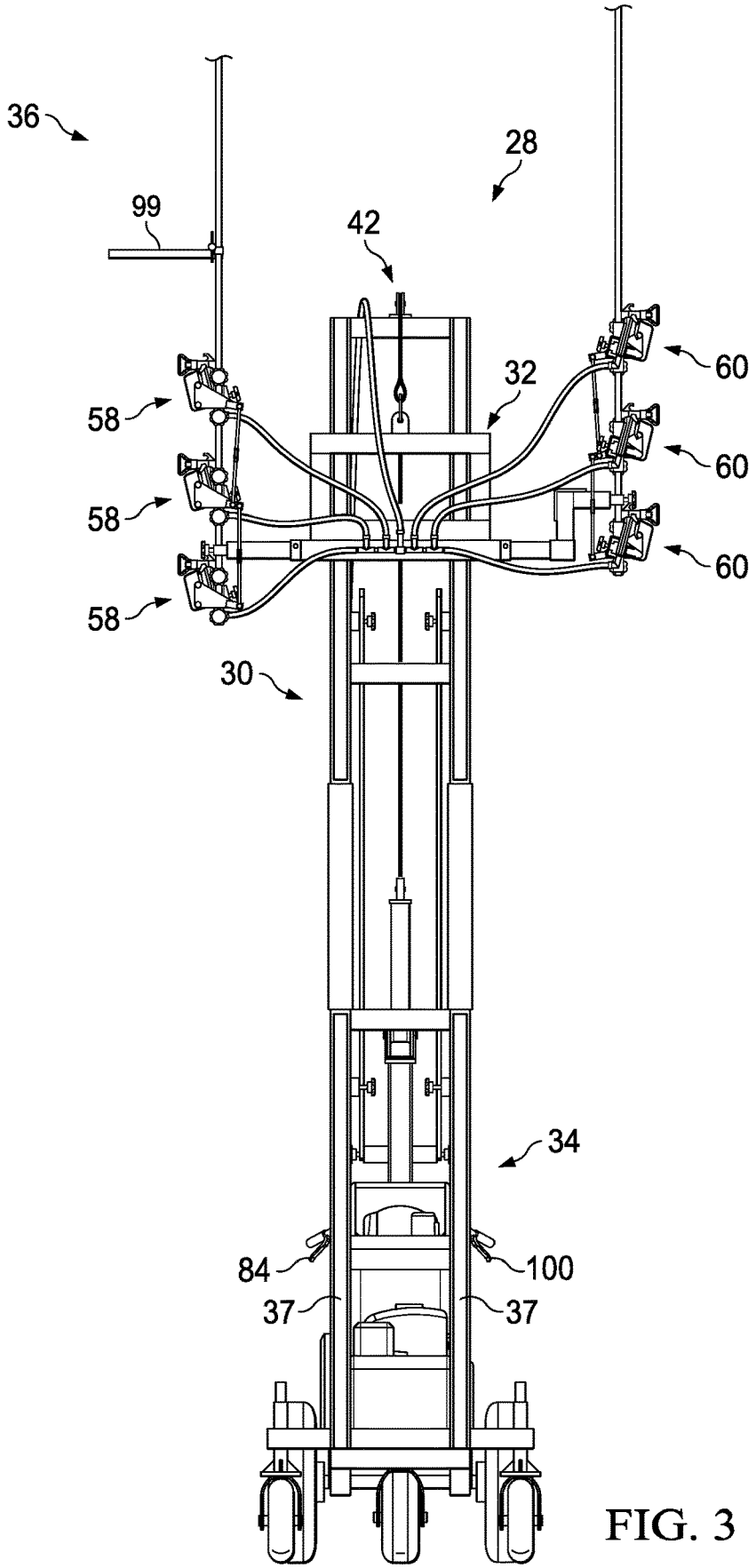
FIG. 3 is a front view depicting the wheeled cart of FIG. 2, but with the carriage in a raised position.

Referring to the drawings, wherein like reference numbers indicate the same or corresponding elements throughout the views, FIGS. 1-4 illustrate a system 10, according to one embodiment, for painting a structure. As illustrated in FIGS. 1-3, the system 10 can include a wheeled cart 12 having handlebars 14 that can be grasped by a user. The wheeled cart 12 can be a push-type cart that is moved by a user pushing/pulling the handlebars 14 and/or can be a self-powered cart that is moved by actuating a lever or other device on the wheeled cart 12. The wheeled cart 12 can include a pair of outer front wheels 18, a center front wheel 20, and a pair of rear wheels 22. The wheels 18, 20, 22 can be rotatably coupled with a frame 24, such that the wheeled cart 12 can move, or roll, along a surface. The outer front wheels 18 and the center front wheel 20 can be pivotable to allow for steering of the wheeled cart 12. The center front wheel 20 can be selectively locked in a straight forward position through actuation of lever (not shown), to facilitate straight forward movement of the wheeled cart 12. The wheeled cart 12 can also include a drivetrain (not shown) for transferring torque from a source of motive power to at least one of the front wheels 18, 20 and the rear wheels 22, such that the wheeled cart 12 can be driven by an operator. In one embodiment, the wheeled cart 12 can include a leveling mechanism (not shown) that can facilitate leveling of the wheeled cart 12 prior to use. In some embodiments, this leveling mechanism can include wheeled outriggers that can be adjusted to level the wheeled cart 12 while still permitting movement of the wheeled cart 12.

Still referring to FIGS. 1-3, the wheeled cart 12 can also include a lift structure 28 that can be coupled with the frame 24. The lift structure 28 can include a mast 30 and a carriage 32 that is vertically slidable on the mast 30. The mast 30 can have a lower portion 34 and an upper portion 36 that is releasably coupled with the lower portion 34. The upper portion 36 can be selectively removed to accommodate for use of the wheeled cart 12 in low clearance areas and/or to aid in effective transporting of the wheeled cart 12 (e.g., in a trailer). A pair of support rails 37 can be coupled to the frame 24 and the upper portion 36 of the mast 30 to provide support to the upper portion 36 of the mast 30. When the upper portion 36 is removed, the support rails 37 can be pivoted into a lower position and attached to the lower portion 34 to provide support for the lower portion 34.

A cable 38 can be attached at one end to the carriage 32 and at the other end to a winch 40. The winch 40 can be operated (e.g., manually or with a motor) to facilitate positioning of the carriage 32 along the mast 30 between a lower position (FIGS. 1 and 2) and an upper position (FIG. 3). The cable 38 can be routed over either an upper pulley 42 (FIG. 3) or a lower pulley 44 (FIG. 1) depending upon whether the upper portion 36 of the mast 30 is attached. It is to be appreciated that the carriage 32 can be alternatively raised and lowered by a system that can include one or more hydraulic cylinders and one or more chains, in a manner known in the art. In other embodiments, movable carriages can be provided that can be raised and lowered in a manner other than that shown. It is also to be appreciated that the height of the mast 30 can be selected or varied (e.g., via a telescoping arrangement) to allow the carriage 32 to be raised to any desirable elevation.

The wheeled cart 12 can include a sprayer assembly 50 that facilitates the spraying of paint, or other fluid, from the wheeled cart 12. The sprayer assembly 50 can include a pump 52, a reservoir 54, a manifold 56, a plurality of right spray heads 58, and a plurality of left spray heads 60. The pump 52 can be in fluid communication with the manifold 56 via a main feed line 62. Each of the right and left spray heads 58, 60 can be in fluid communication with the manifold 56 via respective distribution lines (e.g., 64). When the pump 52 operates, paint can be pumped from the reservoir 54 to the manifold 56 via the main feed line 62 and distributed to the right and left spray heads 58, 60 via the distribution lines (e.g., 64). It is to be appreciated that paint can be delivered from the reservoir 54 to the manifold 56 via any of a variety of suitable additional or alternative methods.

Figure 4:
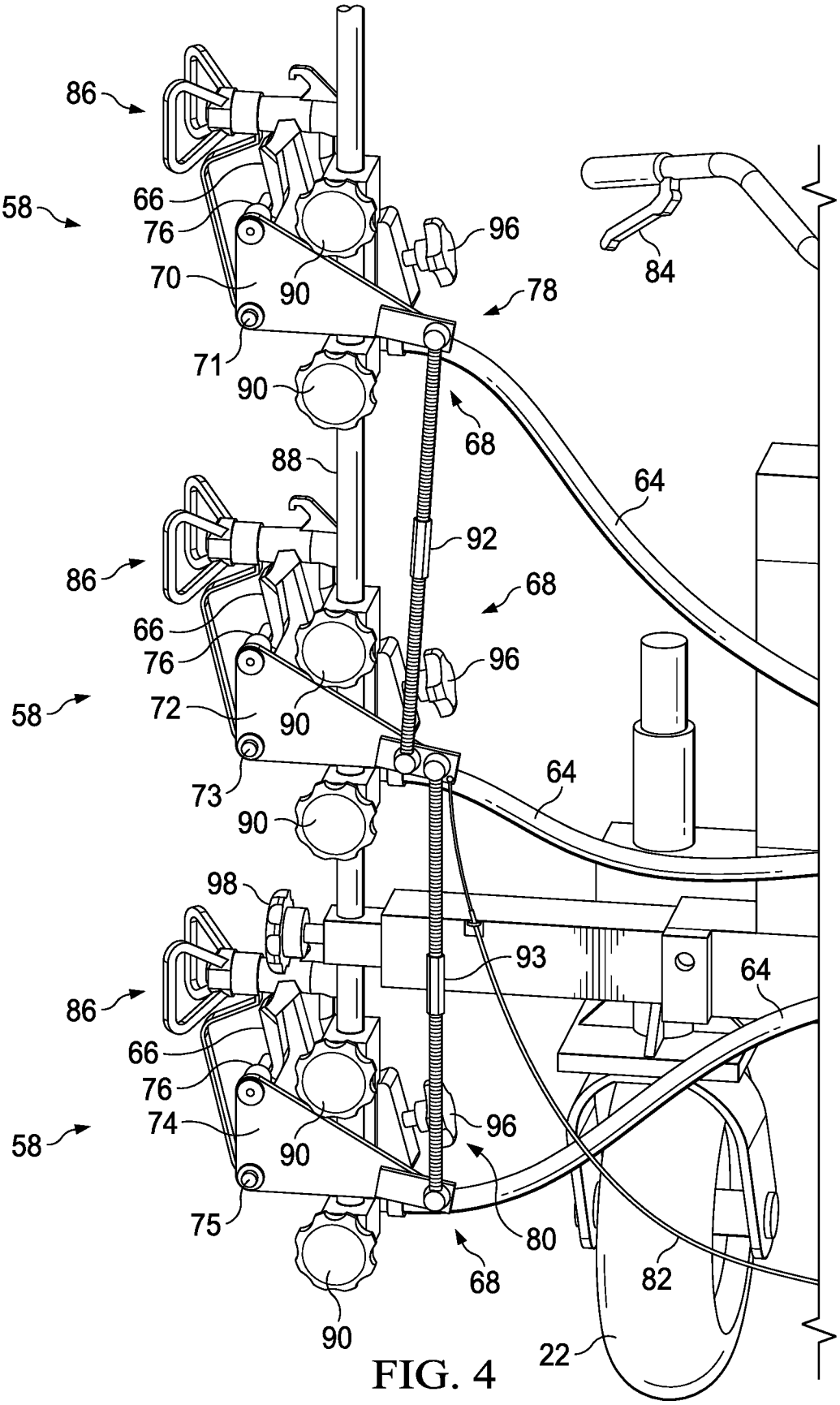
FIG. 4 is an enlarged view depicting right spray heads of the carriage of FIG. 1 in association with various other components of the wheeled vehicle.

Referring now to FIG. 4, operation of the right spray heads 58 will now be discussed. Each of the right spray heads 58 can include a trigger 66, which, when actuated, causes paint to spray from the right spray heads 58. A triggering mechanism 68 can be associated with each of the triggers 66 to facilitate selective depression of the triggers 66. The triggering mechanism 68 can include upper, central and lower trigger plates 70, 72, 74 that are each associated with one of the triggers 66. Each of the trigger plates 70, 72, 74 can include a post 76 that engages the respective trigger 66 of each right spray head 58. The trigger plates 70, 72, 74 can be pivotable about respective pins 71, 73, 75. An upper tie rod 78 can be pivotally coupled to the upper and central trigger plates 70, 72 and a lower tie rod 80 can be pivotally coupled to the central and lower trigger plates 72, 74. A cable 82 can be coupled to the central trigger plate 72 and operably connected to a left lever 100 on the handlebars 14 (FIG. 1). When the left lever 100 is actuated, the cable 82 can pull the central trigger plate 72 downwardly such that it pivots in a clockwise direction. This pivoting of the central trigger plate 72 can cause the upper and lower trigger plates 70, 74 to correspondingly pivot (e.g., via upper and lower tie rods 78, 80). Pivoting of the trigger plates 70, 72, 74 in this manner can actuate the triggers 66 of the right spray heads 58 substantially simultaneously to dispense paint therefrom. In one embodiment, the cable 82 can be a Bowden-type cable. It is to be appreciated that any of a variety of alternative actuator arrangements can be provided to facilitate substantially simultaneous dispensation of paint from multiple spray heads. For example, each of the spray heads can be electronically actuated, such as with a servo, that is controlled in response to actuation of a pushbutton. The operation of these electronic actuators can be automated by an electronic control unit or other suitable control interface.

In one embodiment, right spray heads 58 can be a Low Overspray Cleanshot™ Valve made by Graco Inc. The right spray heads 58 can have respective tips 86 and/or nozzles (not shown) that can be selected to provide a desired spray pattern. In one embodiment, the carriage 32 can be fitted with paint shields (not shown) that are associated with the right and left spray heads 58, 60 and configured to inhibit overspray along the painted surface as well as the surface beneath the carriage 32 (e.g., the ground).

The vertical positions of the right spray heads 58 can be adjusted relative to one another to achieve a desired vertical spacing between adjacent right spray heads 58 to achieve a desired overlap of the spray patterns of each adjacent pair of the right spray heads 58. In one embodiment, each of the right spray heads 58 can be slidably coupled to a right support post 88 and can include a pair of rotatable knobs 90 that can selectively lock the vertical position of the right spray heads 58 with respect to the right support post 88. When one of the right spray heads 58 is locked, both of the rotatable knobs 90 can be rotated in one direction (e.g., counterclockwise) to release the right spray head 58 such that it is free to slide along the right support post 88. Once a position of the right spray head 58 has been selected, both of the rotatable knobs 90 can be rotated in the other direction (e.g., clockwise) to lock the right spray head 58 in place.

Still referring to FIG. 4, the upper and lower tie rods 78, 80 are shown to include respective turnbuckles 92, 93 that can be rotated to change the length of the upper and lower tie rods 78, 80. When a user wants to change the position of adjacent right spray heads 58 relative to each other, the appropriate turnbuckle(s) 92, 93 can be rotated to adjust the length of the upper and lower tie rod(s) 78, 80 accordingly. For example, when the right spray heads 58 associated with the upper and central trigger plates 70, 72 are to be moved relative to each other, the turnbuckle 92 can be rotated to change the length of the upper tie rod 78 to allow for such movement. Similarly, when the right spray heads 58 associated with the central and lower trigger plates 72, 74 are to be moved relative to each other, the turnbuckle 93 can be rotated to change the length of the lower tie rod 80 to allow for such movement. It is to be appreciated that the tie rods and/or the turnbuckles can be any of a variety of lengths to allow for certain travel distances between adjacent spray heads. For example, longer turnbuckles can be provided on the upper and lower tie rods 78, 80 to allow for greater distance variation between the right spray heads 58.

Each of the right spray heads 58 can include a rear rotatable knob 96 that can be rotated to vary the angle of the right spray heads 58 with respect to the right support post 88. Releasing the rear rotatable knobs 96 can also allow the right spray heads 58 and corresponding trigger plates 70, 72, 74 to rotate about the right support post 88. The right spray heads 58 can accordingly be moved in any XYZ direction to conform to any of a variety of applications. The right support post 88 can be selectively held in place with a main rotatable knob 98.

Referring again to FIGS. 1-3, a feeler arm 99 can be provided on the right support post 88 that defines an appropriate distance for the right spray heads 58 relative to the paint surface. As the wheeled cart 12 moves along the paint surface, the user can monitor the feeler arm 99 and can steer the wheeled cart 12 to ensure that the feeler arm 99 remains close to the paint surface without touching it. This can provide a consistent application of paint and can reduce striping/over-application in particular areas.

It is to be appreciated that the left spray heads 60 can be similar to the right spray heads 58, but instead mounted on a left side of the wheeled cart 12. Triggering mechanisms 69 (FIG. 2) can be associated with the left spray heads 60 and can be similar to, or the same as, in many respects as the triggering mechanisms 68. However, the triggering mechanisms 69 can be selectively actuated by a right lever 84 mounted on the handlebars 14. It is to be appreciated that in some embodiments, each of the triggering mechanisms 68, 69 can be actuated together by a single lever or other suitable device.

It is to be appreciated that the right and left spray heads 58, 60 can be arranged to paint any of a variety of surfaces including but not limited to overhead surfaces. It is also to be appreciated that although the right and left spray heads 58, 60 are described as dispensing paint, that any of a variety of suitable alternative fluids can be dispensed from the carriage 32, such as other coatings, solvents, water, or the like.

The system 10 can be used to paint a variety of structures, such as an exterior surface of a building (not shown). To begin painting the structure, the distance between each of the right spray heads 58 and left spray heads 60 can be selected. The wheeled cart 12 can then be provided substantially parallel to the structure with one set of the spray heads (e.g., the right spray heads 58) proximate the structure. The user can then actuate the right lever 84 to dispense paint from the right spray heads 58 and can walk the wheeled cart 12 along the structure to apply a first coat of paint to the structure. Once the first horizontal coat has been successfully applied (i.e., the entire length of the paint surface has been traversed), the wheeled cart 12 can be turned around such that the other set of the spray heads (e.g., the left spray heads 60) is now proximate the structure. The user can then actuate the left lever 100 to dispense paint from the left spray heads 60 and can walk the wheeled cart 12 along the structure to apply a second horizontal coat of paint to the structure. Once the second horizontal coat has been successfully applied, the wheeled cart 12 can be turned around such that the original set of the spray heads (e.g., the right spray heads 58) is again proximate the structure. The carriage 32 can then be raised until the original spray heads are positioned adjacent to the unpainted surface above the newly applied paint. The user can then apply first and second coats of paint to the unpainted surface in the manner described above. The user can then raise the carriage 32 to reach a more elevated surface of the structure and can repeat the process until the entire surface has been painted.

In one embodiment, the carriage 32 can be provided with a back roller (not shown) that rolls the painted surface after spraying to facilitate more even distribution of paint. It is to be appreciated that, in one embodiment, as shown in FIGS. 1-3, the positions of the right spray heads 58 can be staggered with respect to the positions of the left spray heads 60 to provide a more consistent application of paint. For example, if the right spray heads 58 are positioned at 0 inches, 12 inches, and 24 inches (measured from bottom of the right support post 88), the left spray heads 60 can be positioned at 6 inches, 18 inches, and 30 inches.

It is to be appreciated that the system 10 can incorporate many of the features and solve many of the challenges described in U.S. Pat. No. 8,726,833, which is hereby incorporated by reference herein in its entirety.

Figure 5:
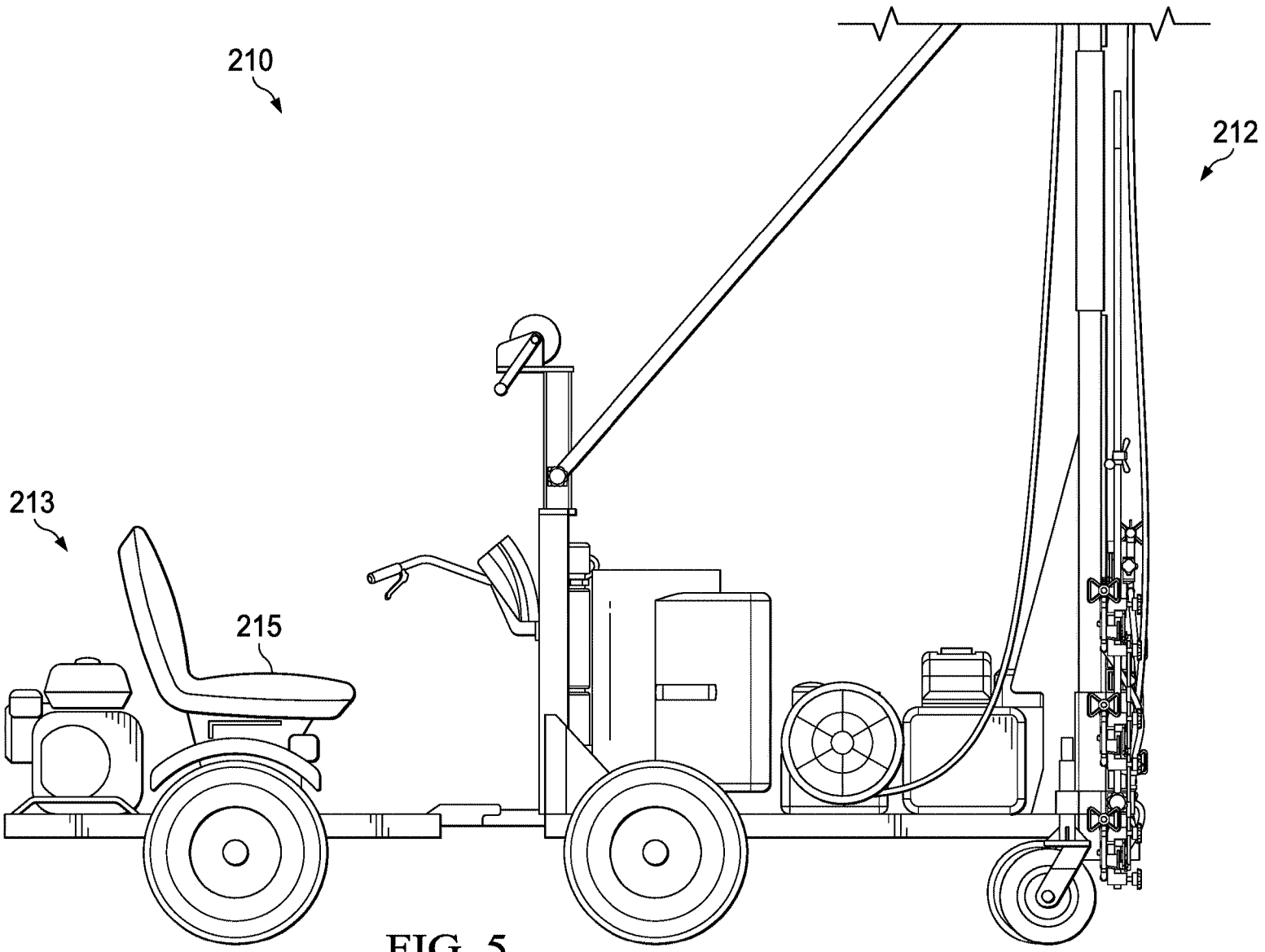
FIG. 5 is a side view depicting a system for painting a structure according to another embodiment.

FIG. 5 illustrates a system 210 according to another embodiment. The system 210 can have a wheeled cart 212 that is similar to, or the same as, in many respects as wheeled cart 12. However, the wheeled cart 212 can be coupled with a passenger operated motorized cart 213 (e.g., collectively a wheeled vehicle 211) having a seat 215 that supports an operator. The passenger operated motorized cart 213 can propel the wheeled cart 212 and can allow for steering of the wheeled cart 212 from the passenger operated motorized cart 213. The passenger operated motorized cart 213 can be a golf cart, a tractor, a truck, a sport utility vehicle (SUV), an all-terrain vehicle (ATV), a utility vehicle (UTV), or any of a variety of suitable alternative fuel-powered or electric-powered vehicles.

Figure 6:
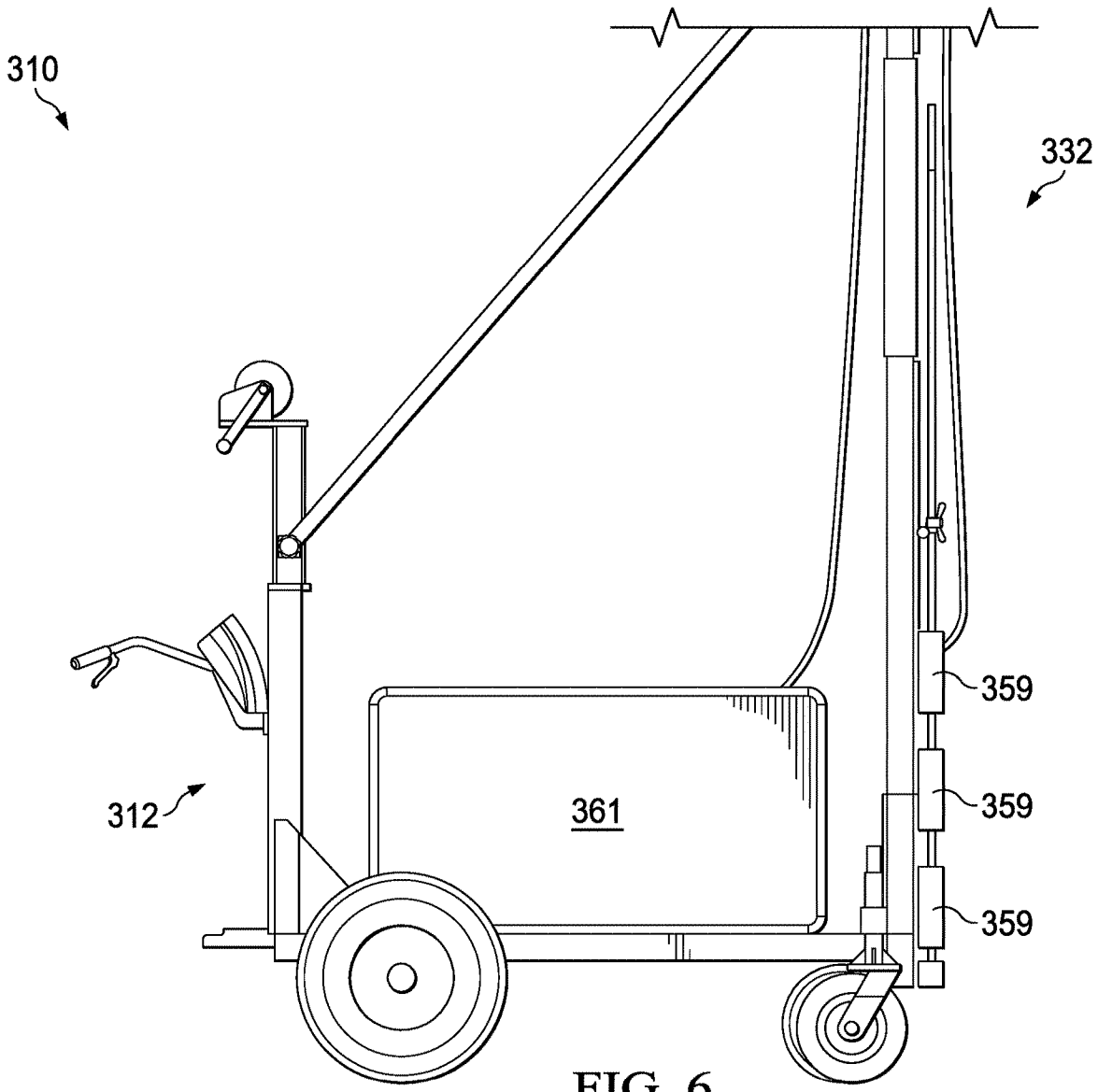
FIG. 6 is a side view depicting a system for painting a structure according to yet another embodiment.

FIG. 6 illustrates a system 310 that is similar to, or the same as, in many respects as the systems 10, 210 of FIGS. 1-4 and 5, respectively. For example, the system 310 can include a wheeled cart 312 and a carriage 332. However, the system 310 can include a plurality of surface treatment devices 359 and a supply unit 361 associated with the surface treatment devices 359. The surface treatment devices 359 can be any of a variety of devices that facilitate other treating methods for a surface, such as, for example, a power washer, scrubber, sand blaster, or the like. The supply unit 361 can be any device that facilitates a supply of appropriate material(s) to the surface treatment devices 359 that facilitate the other treating methods. For example, the supply unit 361 can be configured to provide water for power washing or scrubbing or to provide sand for sand blasting.

Figure 7:
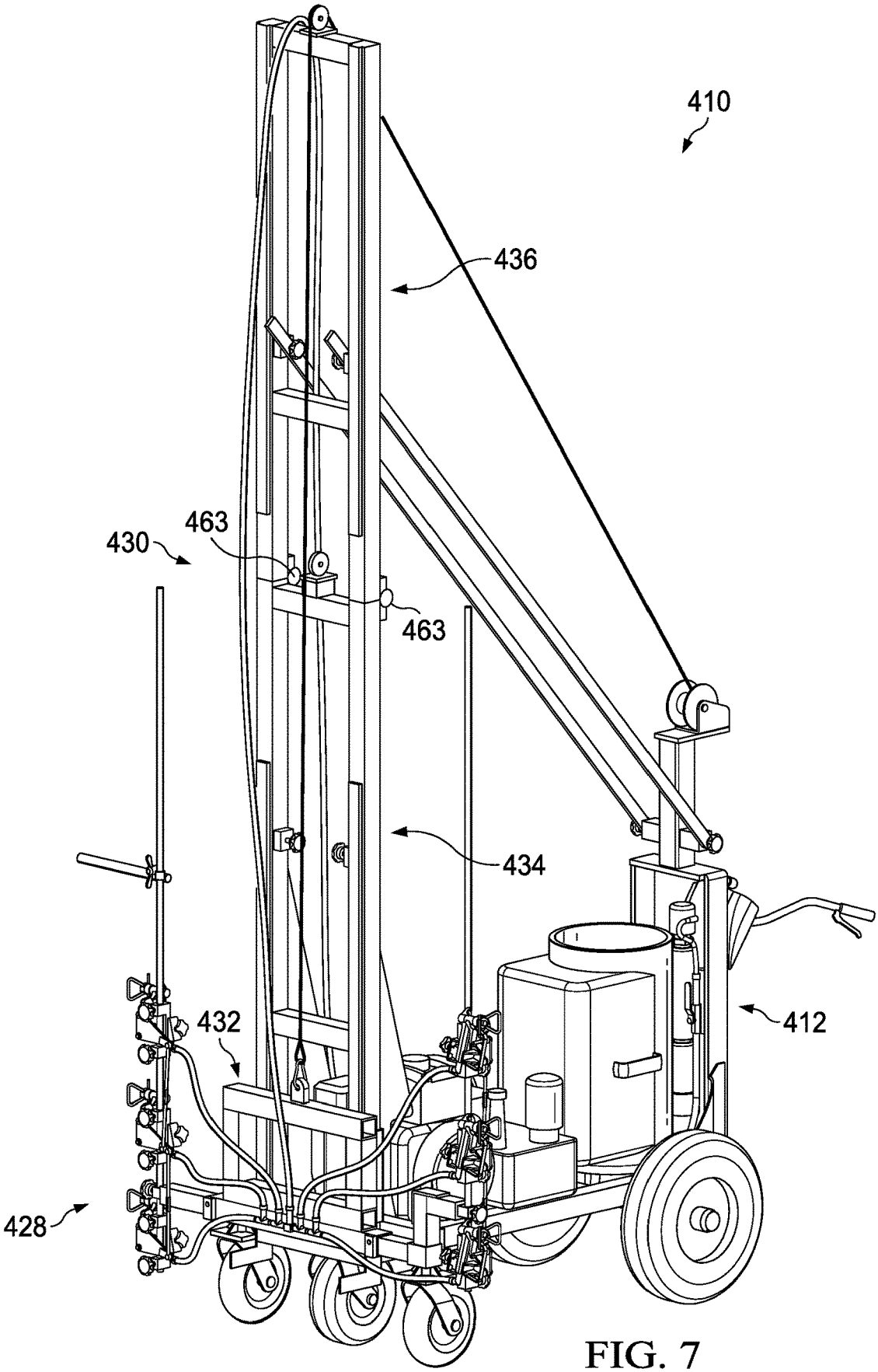
FIG. 7 is a perspective view depicting a system for painting a structure according to another embodiment.

FIG. 7 illustrates a system 410 that is similar to, or the same as, in many respects as the system 10 of FIGS. 1-4. For example, the system 410 can include a wheeled cart 412 that includes a lift structure 428. The lift structure 428 can include a mast 430 and a carriage 432 that is vertically slidable on the mast 430. The mast 430 can have a lower portion 434 and an upper portion 436. The lower and upper portions 434, 436, however can be pivotally coupled together with a pair of hinges 463 such that the upper portion 436 can be pivoted with respect to the lower portion 434 between an upright position (shown in FIG. 7) and a collapsed position (not shown). The upper portion 436 can be pivoted into the collapsed position to accommodate for use of the wheeled cart 412 in low clearance areas and/or to aid in effective transporting of the wheeled cart 412 (e.g., in a trailer).

Figure 8:
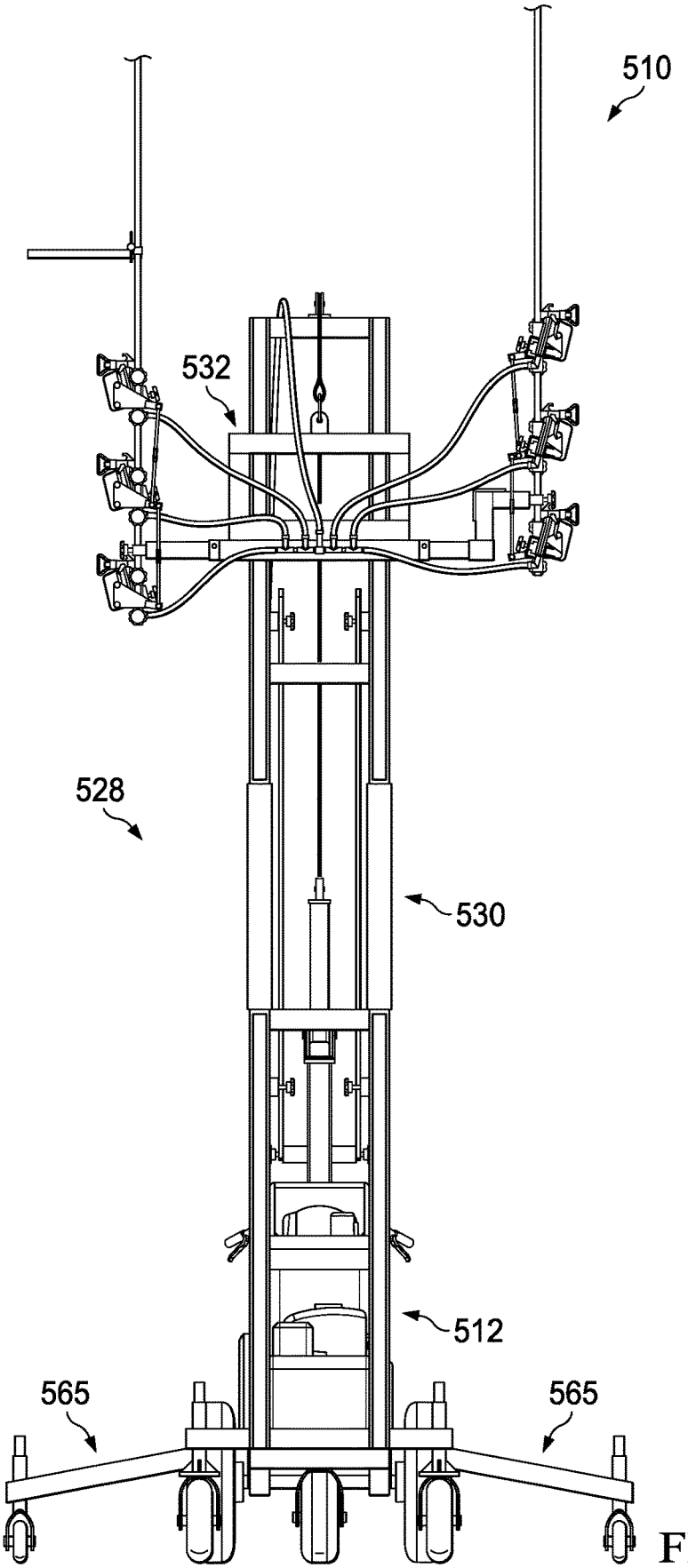
FIG. 8 is a front view depicting a system for painting a structure according to yet another embodiment.

FIG. 8 illustrates a system 510 that is similar to, or the same as, in many respects as the system 10 of FIGS. 1-4. For example, the system 510 can include a wheeled cart 512 that includes a lift structure 528. The lift structure 528 can include a mast 530 and a carriage 532 that is vertically slidable on the mast 530. However, the wheeled cart 512 can include a pair of wheeled outriggers 565 that can be selectively deployed to enhance the overall stability of the wheeled cart 512 during operation.

Figure 9:
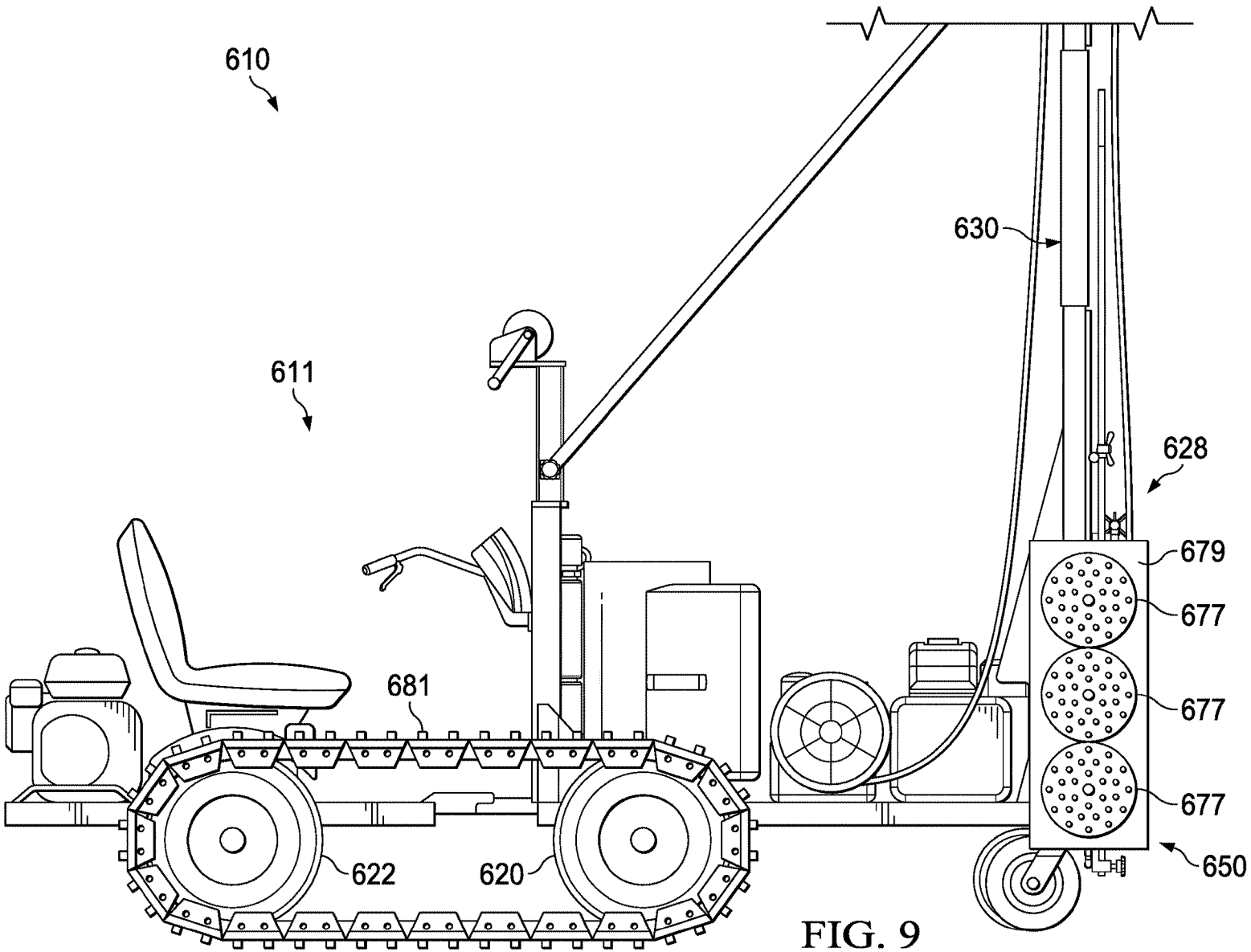
FIG. 9 is a side view depicting a system for painting a structure according to still yet another embodiment.

FIG. 9 illustrates a system 610 that is similar to, or the same as, in many respects as the systems 10 and 210 of FIGS. 1-4 and 5, respectively. For example, the system 610 can include a wheeled vehicle 611 that includes front wheels 620 (one shown), rear wheels 622 (one shown), and a lift structure 628. The lift structure 628 can include a mast 630 and a carriage (not shown) that is vertically slidable on the mast 630.

However, a surface treatment assembly 650 can be coupled with the carriage and can include a plurality of rotary brush heads 677 and a shroud 679 provided on a right side of the lift structure 628. The rotary brush heads 677 can contact a vertical surface and can be selectively rotated to facilitate cleaning or polishing of the vertical surface. The shroud 679 can at least partially surround the rotary brush heads 677 to shield the rest of the system from at least some of the debris removed from the vertical surface. In one embodiment, as illustrated in FIG. 9, the rotary brush heads 677 can comprise wire cup brushes that are firm enough to facilitate removal of material (e.g., debris or paint) from the vertical surface. However, any of a variety of suitable alternative rotary surface treatment devices are contemplated, such as, for example, grinding wheels, polishing heads, or soft-bristled heads (e.g., for light cleaning and/or polishing). In one embodiment, a vacuum duct (not shown) can be associated with the shroud 679 and configured to facilitate extraction of at least some of the dust or debris that is removed from the vertical surface. It is to be appreciated that the rotary brush heads 677 can be powered pneumatically, electrically, or with any of a variety of suitable alternative motive sources. It is also to be appreciated that although the rotary brush heads 677 are shown on the right side of the lift structure 628, rotary brush heads can additionally or alternatively be provided on a left side of the lift structure 628.

Still referring to FIG. 9, the wheeled vehicle 611 can include a track 681 that is routed around the front and rear wheels 620, 622 to allow the system 610 to be driven off road. The front and rear wheels 620, 622 can also be supported with a suspension system (e.g., shocks) (not shown) to facilitate dampening of the effects of driving the wheeled vehicle 611 off-road.

Figure 10:
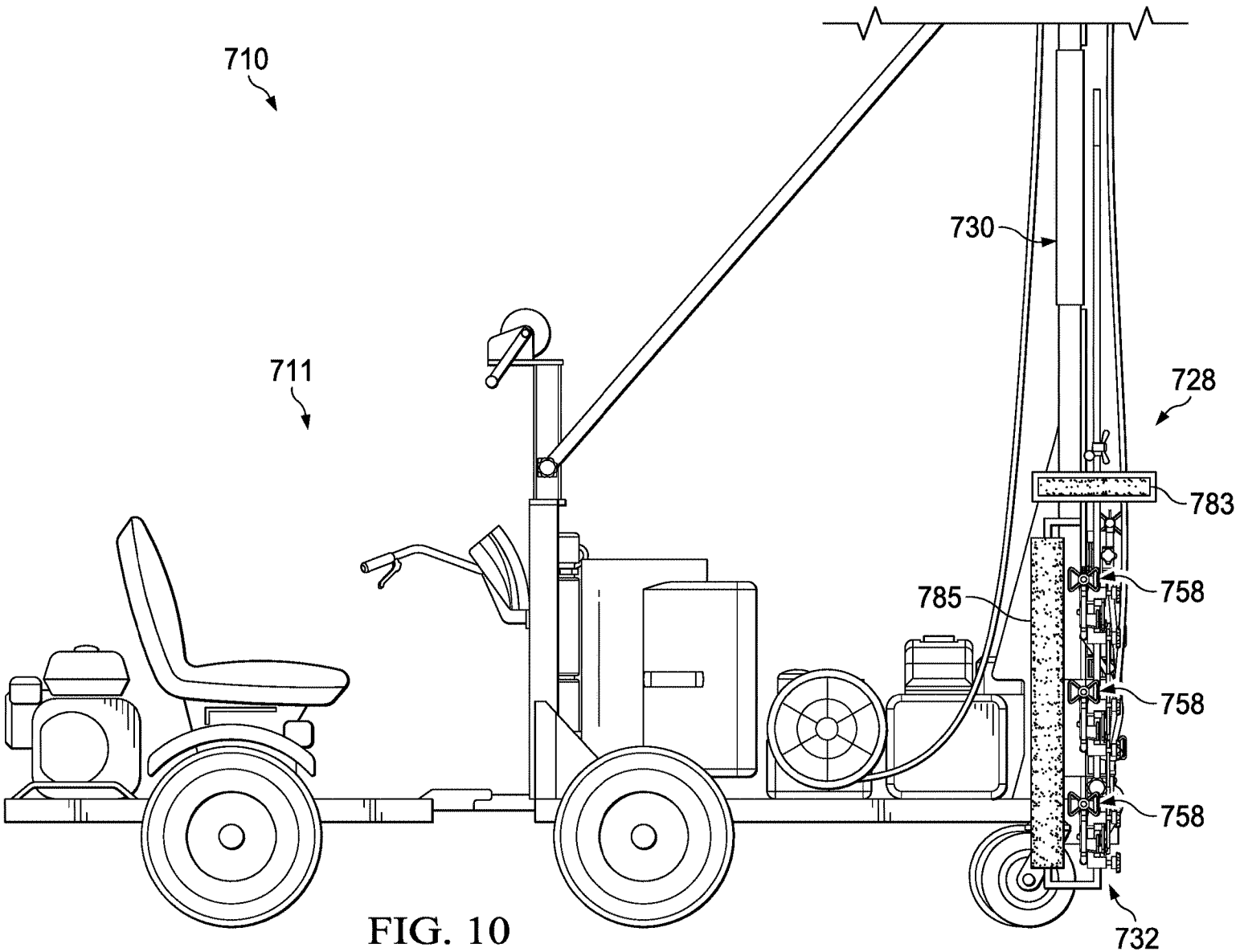
FIG. 10 is a side view depicting a system for painting a structure according to still yet another embodiment.

FIG. 10 illustrates a system 710 that is similar to, or the same as, in many respects as the systems 10 and 210 of FIGS. 1-4 and 5, respectively. For example, the system 710 can include a wheeled vehicle 711 that includes a lift structure 728. The lift structure 728 can include a mast 730 and a carriage 732 that is vertically slidable on the mast 730. A plurality of right spray heads 758 can be coupled with the carriage 732 and arranged vertically. However, the system 710 can include an edging roller 783 disposed vertically above the plurality of right spray heads 758 (e.g., above a vertically uppermost right spray head 758). During painting of a vertical surface, the edging roller 783 can contact the vertical surface to serve as a mask such that fluid from the right spray heads 758 is prevented from being sprayed above the edging roller 783. As the wheeled vehicle 711 is driven along the vertical surface, the edging roller 783 can roll along the vertical surface to facilitate formation of a horizontal line with the dispensed fluid (e.g., to cut in a horizontal line). In one embodiment, the edging roller 783 can be formed of a compliant material, such as an elastomeric or soft foam, for example, such that the edging roller 783 can be slightly deformed against the vertical surface to provide an effective fluid barrier therebetween. It is to be appreciated that although the edging roller 783 is shown to be disposed above the right spray heads 758, an edging roller can additionally or alternatively be provided beneath the right spray heads 758 for cutting in a line adjacent to a floor. It is also to be appreciated that any of a variety of suitable alternative edging devices are contemplated for cutting in a line above or below the right spray heads 758.

Still referring to FIG. 10, a back roller 785 can be provided adjacent to the right spray heads 758. During painting of a vertical surface, the back roller 785 can roll along the painted surface to facilitate more even distribution of paint. It is to be appreciated that although the edging roller 783 and the back roller 785 are shown on the right side of the lift structure 728, an edging roller and/or back roller can additionally or alternatively be provided on a left side of the lift structure 728.

Figure 11:
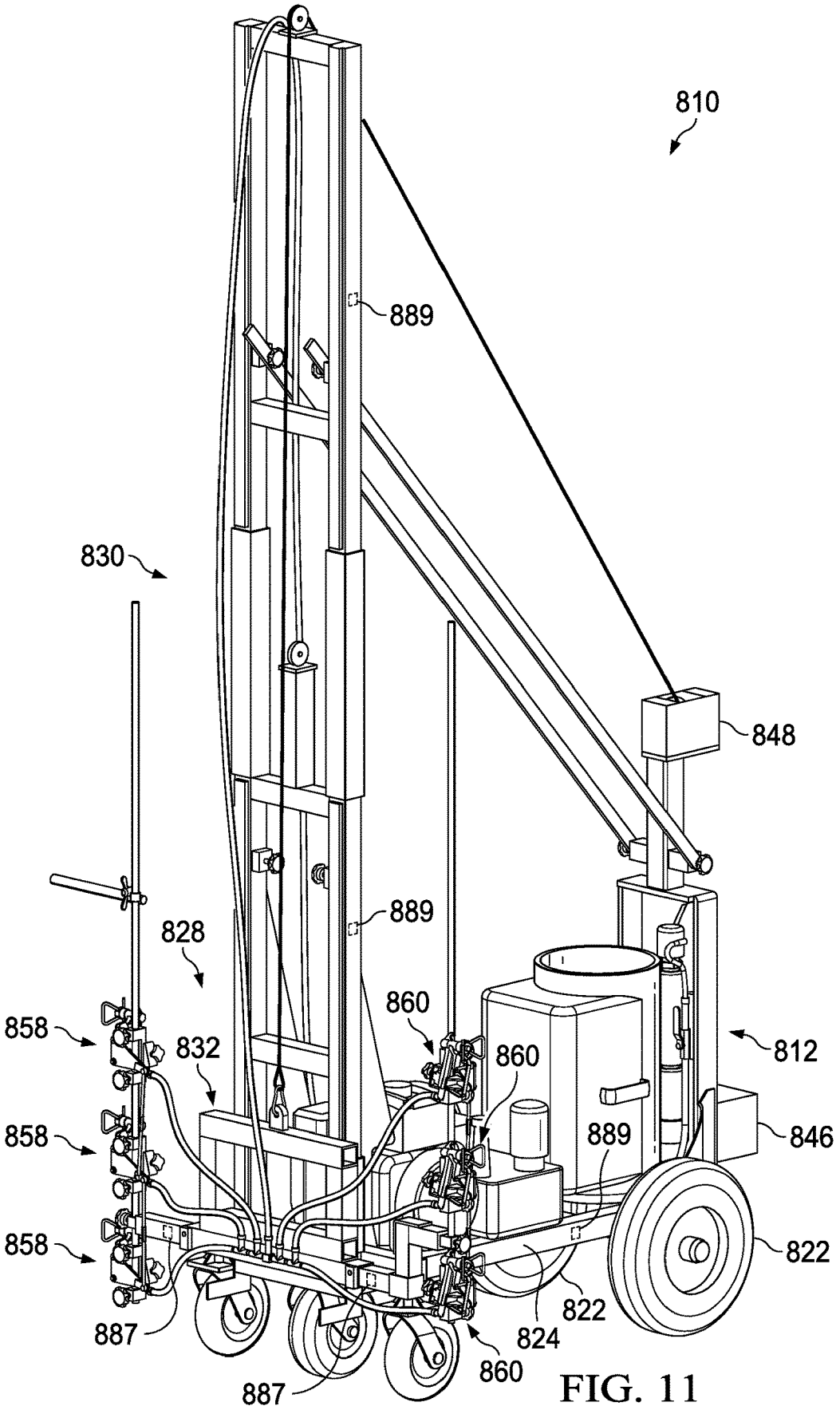
FIG. 11 is a perspective view depicting a system for painting a structure according to another embodiment.

FIG. 11 illustrates a system 810 that is similar to, or the same as, in many respects as the system 10 of FIGS. 1-4. For example, the system 810 can include a wheeled cart 812 that includes, a pair of powered rear wheels 822, a frame 824, and a lift structure 828. The lift structure 828 can include a mast 830 and a carriage 832 that is vertically slidable on the mast 830. A plurality of right and left spray heads 858, 860 can be coupled with the carriage 832.

Figure 12:
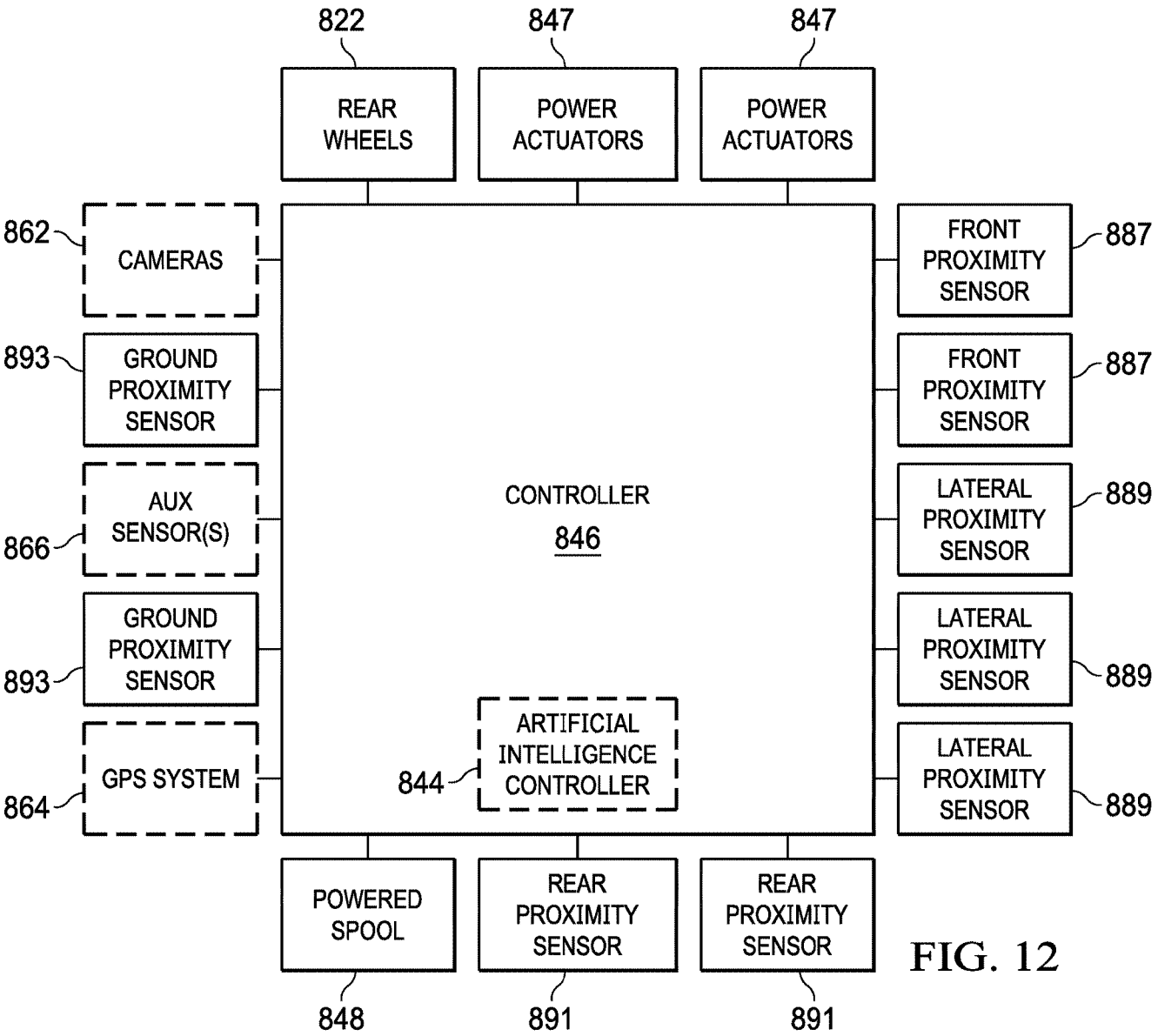
FIG. 12 is a schematic view depicting a controller of the system of FIG. 11 in association with various components of the system.

However, as illustrated in FIGS. 11 and 12, the system 810 can include a controller 846 that facilitates automated control of the wheeled cart 812. The controller 846 can be operably coupled with the powered rear wheels 822 to facilitate automated navigation of the wheeled cart 812. The controller 846 can also be associated with a pair of power actuators 847 (FIG. 12) that are each is associated with one of the right and left spray heads 858, 860 to facilitate automated dispensation of fluid from the right and left spray heads 858, 860. In one embodiment, each of the power actuators 847 can be provided in lieu of triggers (e.g., 66) and/or triggering mechanisms (e.g., 68) associated with respective ones of the right spray heads 858 and the left spray heads 860. The wheeled cart 812 can include a powered spool 848 that is associated with the controller 846 and configured to facilitate powered raising and lowering of the carriage 832. In one embodiment, the powered spool 848 can be hydraulically powered (e.g., from an existing on-board hydraulic system on the wheeled cart 812). In another embodiment, the powered spool 848 can be electrically powered. It is to be appreciated that the system 810 can additionally or alternatively include other power actuators (not shown) that are provided in lieu of other mechanical features to facilitate automated actuation thereof.

As will be discussed in further detail below, the controller 846 can selectively and independently facilitate operation of the powered rear wheels 822, the right and left spray heads 858, 860, and the powered spool 848 to apply fluid to a vertical surface autonomously (e.g., without continuous human intervention), as will be described in further detail below.

The system 810 can include front proximity sensors 887 and lateral proximity sensors 889. The front proximity sensors 887 can be provided on the carriage 832 and configured to monitor an area in front of the wheeled cart 812. One of the lateral proximity sensors 889 can be provided on a left side of the frame 824 and two of the lateral proximity sensors 889 can be provided on a left side of the mast 830 and configured to monitor a left side of the wheeled cart 812. Rear proximity sensors (891 FIG. 12) can be disposed on a rear of the wheeled cart 812 and configured to monitor the rear area of the wheeled cart 812. Additional lateral proximity sensors (e.g., 889) can be disposed on a right side of the wheeled cart 812 and configured to monitor the right side of the wheeled cart 812. Ground proximity sensors 893 can be disposed under the carriage 832 and configured to detect the vertical location of the carriage relative to the ground.

The controller 846 can be in communication with the front proximity sensors 887, the lateral proximity sensors 889, the rear proximity sensors 891, and the ground proximity sensors 893 (collectively the "proximity sensors"). During operation of the system 810, some or all of the proximity sensors 887, 889, 891, 893 can provide feedback data to the controller 846 that indicates the proximity of the wheeled cart 812 to nearby objects (e.g., walls or obstacles). The controller 846, in response, can facilitate operation of the powered rear wheels 822 to navigate the wheeled cart 812 along the vertical surface while simultaneously avoiding obstacles. During treatment of a vertical surface, the ground proximity sensors 893 can provide height data to the controller 846 that indicates the height of the carriage 832 relative to a ground surface. The controller 846 can use the height data to maintain a consistent height of the spray heads 858, 860 during treatment and to automatically raise or lower the height of the spray heads 858, 860 to provide consistent and complete fluid coverage along the vertical surface. The proximity sensors 887, 889, 891, 893 can comprise an infrared sensor, an optical sensor, a radar sensor, or any of a variety of suitable alternative sensors for detecting the proximity of the wheeled cart 812 to an object.

One example of the operation of the system 810 will now be described. First, the wheeled cart 812 can be placed near the vertical surface and the controller 846 can be initialized (e.g., with a pushbutton or via a remote computing device) to begin automated coating of the surface. Once initialized, the controller 846 can locate the vertical surface and can position the wheeled cart 812 in a proper starting position. Once the wheeled cart 812 has reached the starting position, the controller 846 can actuate the set of spray heads that is most proximate to the vertical surface (e.g., the right spray heads 858 for purposes of this example) and can operate the powered rear wheels 822 to navigate the wheeled cart 812 along the vertical surface to apply a first horizontal coat of fluid. As the wheeled cart 812 moves along the vertical surface, the controller 846 can monitor the distance between the vertical surface and the right spray heads 858 (via at least one of the lateral sensors) and can adjust the lateral positioning of the wheeled cart 812 to maintain the right spray heads 858 at a distance that provides consistent fluid coverage along the vertical surface. In one embodiment, the controller 846 can control the speed of the wheeled cart 812 as a function of fluid flow rate and distance of the right spray heads 858 from the vertical surface to enhance the coverage quality of the fluid. The controller 846 can also monitor for obstructions in the path of the wheeled cart 812 and can stop the wheeled cart 812 and shut off the right spray heads 858 when an obstruction is detected. In one embodiment, the controller 846 can generate an alarm (e.g., an onboard alarm or via a remote computing device) to notify a user that the path of the wheeled cart 812 is obstructed.

During coating of the vertical surface, the controller 846 can monitor the sprayer assembly (e.g., 50) to ensure proper operation and coating of the vertical surface. In one embodiment, the controller 846 can monitor the fluid level in a reservoir (e.g., 54) and can alert a user when the fluid level is low. In another embodiment, the controller 846 can monitor fluid flow through each of the right and left spray heads 858 to detect an obstruction that might affect the dispensation of paint therefrom.

Once the first horizontal coat has been successfully applied (i.e., the entire length of the paint surface has been traversed), the controller 846 can stop the wheeled cart 812 and can deactivate the right spray heads 858. In one embodiment, the first horizontal coat can be completed once the controller 846 detects that the wheeled cart 812 has encountered a corner wall (e.g., with the front proximity sensors 887). In another embodiment, the first horizontal coat can be completed once the wheeled cart 812 has traveled a predefined distance (as selected by a user). In yet another embodiment, the first horizontal coat can be completed once the wheeled cart 812 reaches a predefined geospatial coordinate (via GPS). In any event, once the wheeled cart 812 is stopped and the right spray heads 858 are deactivated, the controller 846 can raise the carriage 832 (e.g., via the powered spool 848) until the right spray heads 858 are positioned adjacent to an uncoated portion of the vertical surface above the newly applied first horizontal coat (as determined from the ground proximity sensors). The controller 846 can then reverse the direction of the wheeled cart 812 and can apply a second horizontal coat of fluid in a similar manner as described above for the first horizontal coat. The controller 846 can continuously repeat the process until the entire vertical surface has been coated with fluid.

Additionally or alternatively the system 810 can utilize artificial intelligence, such as, for example, machine learning, deep learning, artificial neural networks, convolutional neural networks, recurrent neural networks and/or other models to assist with, control, or monitor various system operations, as schematically shown as artificial intelligence controller 844 in FIG. 12. For the purposes of illustration, the artificial intelligence controller 844 is schematically depicted as being incorporated into the controller 846, however this disclosure is not so limited. Instead, such artificial intelligence controller 844 can be implemented using any suitable controller, processor, graphic processing unit (GPU), field programmable gate array (FPGA), application specific integrated circuit (ASIC), computing system, or combinations thereof, which can be a component of or otherwise associated with the system 810. Moreover, while the artificial intelligence controller 844 is shown to be local to and on-board the system 810, it is to be appreciated that portions or the entirety of the artificial intelligence controller 844 can be hosted remotely from the system 810 and accessible via suitable communication networks.

In accordance with various embodiments, the artificial intelligence controller 844 can be used in conjunction with one or more operational aspects of the system 810. For example, the artificial intelligence controller 844 can be utilized in the automated navigation of the system 810 by controlling operation of the powered rear wheels 822 based on various inputs from the proximity sensors 887, 889, 891, 893. In conjunction with the automated navigation, the artificial intelligence controller 844 can utilize real-time data from other data sources, such as cameras 862 and GPS system 864. Additionally, data can be received from a variety of different types of auxiliary sensors 866, which can include accelerometers, gyroscopes, LiDAR sensor, among others. In addition to utilizing GPS data, image data, sonar data, LiDAR data, inertial data, and/or odometry data, the artificial intelligence controller 844 can also utilize data received from various external sources, such as weather data, mapping data, project data, and so forth. Accordingly, the artificial intelligence controller 844 can facilitate the automated navigation of the system 810 during a surface treatment, as well as navigation to and from the surface treatment site.

Additionally or alternatively, the artificial intelligence controller 844 can be utilized in the automated surface treatment of the system 810. For instance, the artificial intelligence controller 844 can control the pair of power actuators 847 that are each associated with one of the right and left spray heads 858, 860 to facilitate automated dispensation of fluid from the right and left spray heads 858, 860. The artificial intelligence controller 844 can also control the powered spool 848 to facilitate powered raising and lowering of the carriage 832.

In accordance with various embodiments, the artificial intelligence controller 844 can utilize feedback data from various sources and execute real-time operational adjustments. Such data can include image data, sensor data, and so forth that can be used to asses quality of the surface treatment. The artificial intelligence controller 844 can also determine parameters for execution of the surface treatment based on the feedback data, such as speed of the surface treatment, amount of the surface treatment, and location of the surface treatment. With regard to painting a structure, for example, in accordance with various embodiments, the artificial intelligence controller 844 can determine which parts of the structure to paint, determine settings associated with the right and left spray heads 858, 860 based on real-time operational conditions, determine what paint colors should be changed, determine when refilling is required, and so forth. Additionally, through the use of various training algorithms, the artificial intelligence controller 844 can learn to detect quality of the painting and make real-time adjustments to improve quality over time.

In accordance with various embodiments, the artificial intelligence controller 844 can be used in connection with a subset of the overall functionality of the system 810. By way of example, in some embodiments, the navigation of the system 810 can be user-controlled while the surface treatment operations can be executed using the artificial intelligence controller 844. Thus, a user may navigate the system 810 along a structure to perform a surface treatment, while the artificial intelligence controller 844 coordinates delivery of the surface treatment and makes real-time adjustments to improve the quality of the surface treatment.

Figure 13:
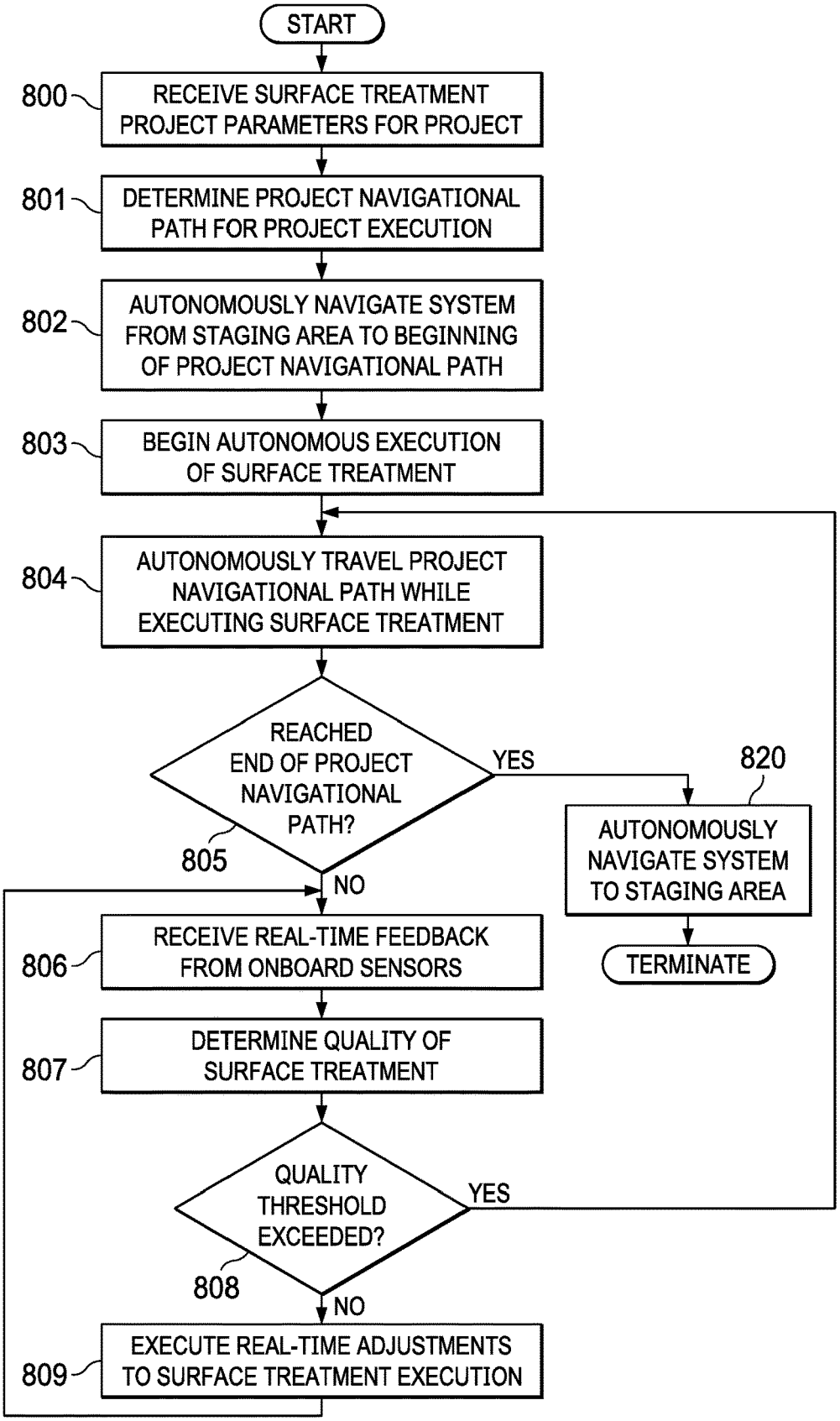
FIG. 13 is a flow chart depicting an example operation of the system of FIG. 11 utilizing an artificial intelligence controller according to one embodiment.

FIG. 13 is a flow chart depicting an example operation of the system 810 utilizing the artificial intelligence controller 844 in accordance with an example embodiment. At process 800, surface treatment project parameters for a project can be received. The surface treatment project parameters for a project can include, without limitation, a type of surface treatment, an amount of surface treatment, a location of the surface treatment, as well as a wide variety of other parameters that can be used by the artificial intelligence controller 844 in planning and executing the surface treatment project. At process 801, the artificial intelligence controller 844 can determine a navigational path for the project execution based on the surface treatment project parameters. By way of example, the navigational path can be a path of travel around the exterior of a structure based on geolocational information received by the artificial intelligence controller 844 from GIS data sources or onboard cameras. The navigational path can be determined to efficiently execute the surface treatment project based on the surface treatment project parameters received at process 800, the terrain proximate to the project site, and obstacles present at the project site. At process 802, the system 810 can be autonomously navigated from a staging area to the beginning of the project navigation path. While in transit, the artificial intelligence controller 844 can be receiving real-time data from cameras, GPS systems, and other systems to intelligently drive the system 810 from the staging area to the beginning of the project navigation path.

At process 803, the system 810 can autonomously execute the surface treatment in accordance with the surface treatment project parameters. During execution of the surface treatment, various electronic actuators can be intelligently controlled by the artificial intelligence controller 844. At process 804, the system 810 can autonomously travel the project navigational path while executing the surface treatment. Using any of a variety of detection techniques, the artificial intelligence controller 844 can detect obstacles in real-time while traveling the project navigational path. Based on the detected obstacles, the artificial intelligence controller 844 can adjust the navigational path as-needed to avoid such obstacles while performing the surface treatment project.

At process 805, it can be determined if the system 810 has reached the end of the project navigational path. If the end of the project navigational path has been reached, at process 820, the system 810 can cease surface treatment operations and be autonomously navigated to the staging area, or other suitable destination. If it is determined at process 805 that the system 810 has not reached the end of the project navigational path, the process continues to process 806. At process 806, real-time feedback from onboard sensors can be received. The real-time feedback can include, for example, image data or other data that can allow the artificial intelligence controller 844 to assess the quality of the surface treatment. At process 807, the quality of surface treatment is determined. Subsequent to determining the quality of the surface treatment at process 807, at process 808, the artificial intelligence controller 844 can determine if a quality threshold has been exceeded. If the quality threshold has been exceeded, the process loops back to process 804 and the system 810 can continue to travel the navigational path while executing the surface treatment. If it is determined at process 808 that the quality threshold has not been exceeded, the process continues to process 809. At process 809, real-time adjustments to the execution of the surface treatment can be performed by the artificial intelligence controller 844. Subsequent to making the adjustments, the process can loop back to process 806 to assess whether the adjustments were sufficient to increase the quality of the surface treatment.

Figure 14:
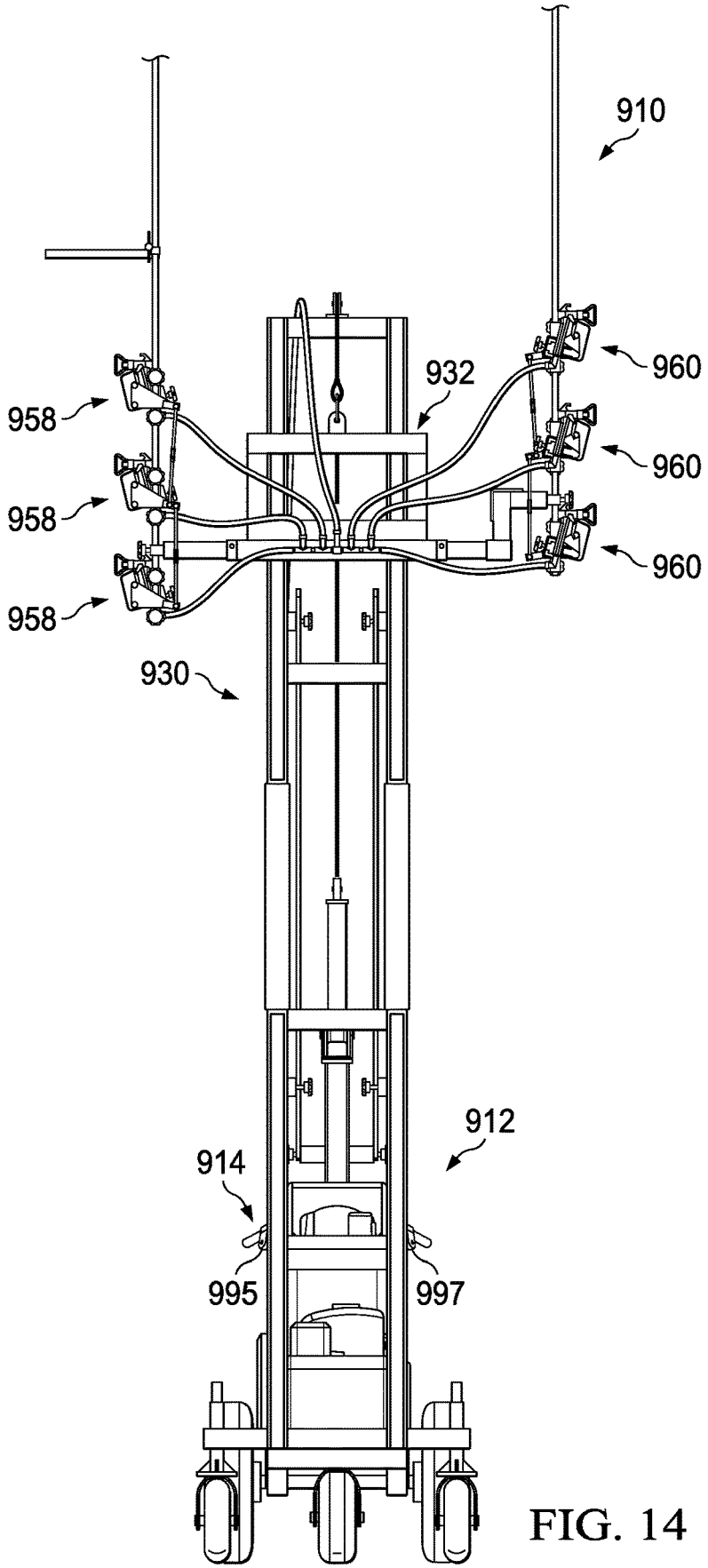
FIG. 14 is a front view depicting a system for painting a structure according to still yet another embodiment.
Figure 15:
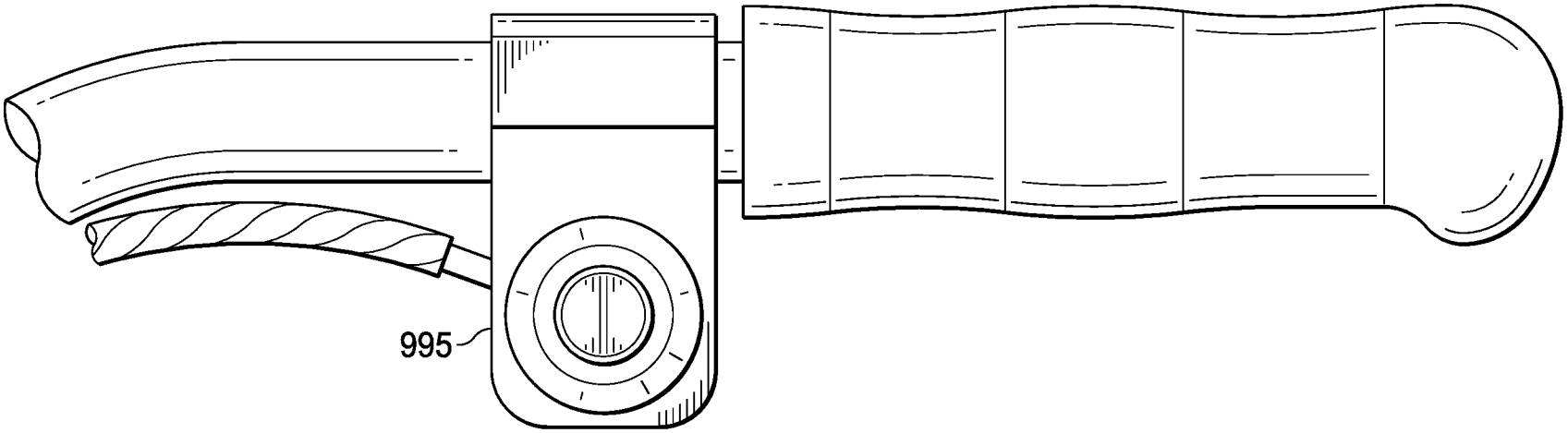
FIG. 15 is an enlarged perspective view of a right electronic actuator of the system of FIG. 14.

FIGS. 14 and 15 illustrate a system 910 that is similar to, or the same as, in many respects as the system 10 of FIGS. 1-4. For example, the system 910 can include a wheeled cart 912 that includes handlebars 914, a mast 930, and a carriage 932 that is vertically slidable on the mast 930. A plurality of right and left spray heads 958, 960 can be coupled with the carriage 932. However, the system 910 can include a right electronic actuator 995 and a left electronic actuator 997 coupled with the handlebars 914 in lieu of the right and left levers 84, 100 illustrated in FIGS. 1-3. The right and left electronic actuators 995, 997 can facilitate selective electronic actuation of the right spray heads 958 and the left spray heads 960, respectively. As illustrated in FIG. 15, the right electronic actuator 995 can include a pushbutton 901 that can be selectively depressed to actuate the right spray heads 958. The left electronic actuator 997 can also include a similar pushbutton (not shown) that can be selectively depressed to actuate the left spray heads 960. It is to be appreciated that any of a variety of suitable alternative electronic actuators are contemplated for electronically actuating the right and left spray heads 958, 960.

Figure 16:
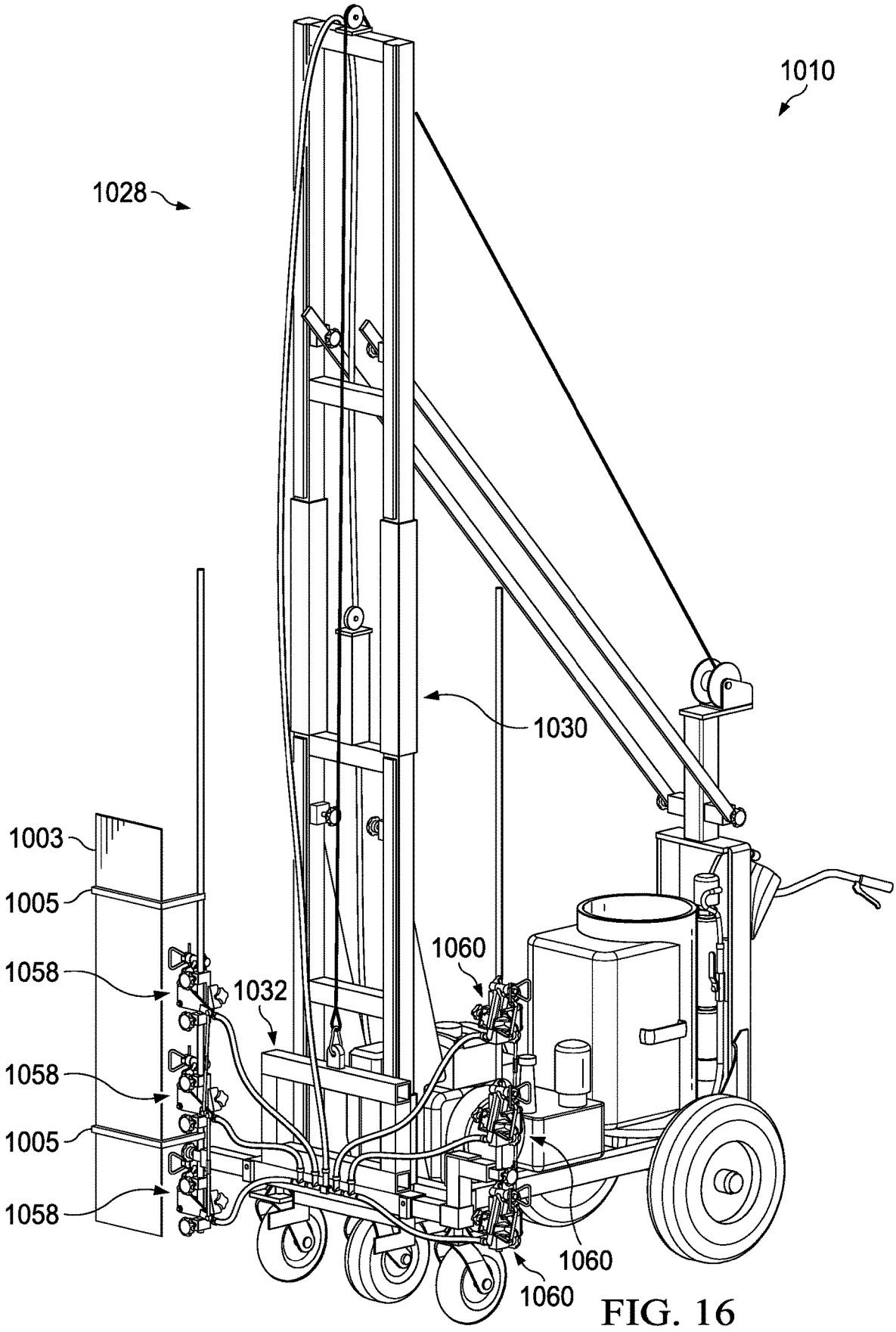
FIG. 16 is a perspective view depicting a system for painting a structure according to still yet another embodiment.
Figure 17:
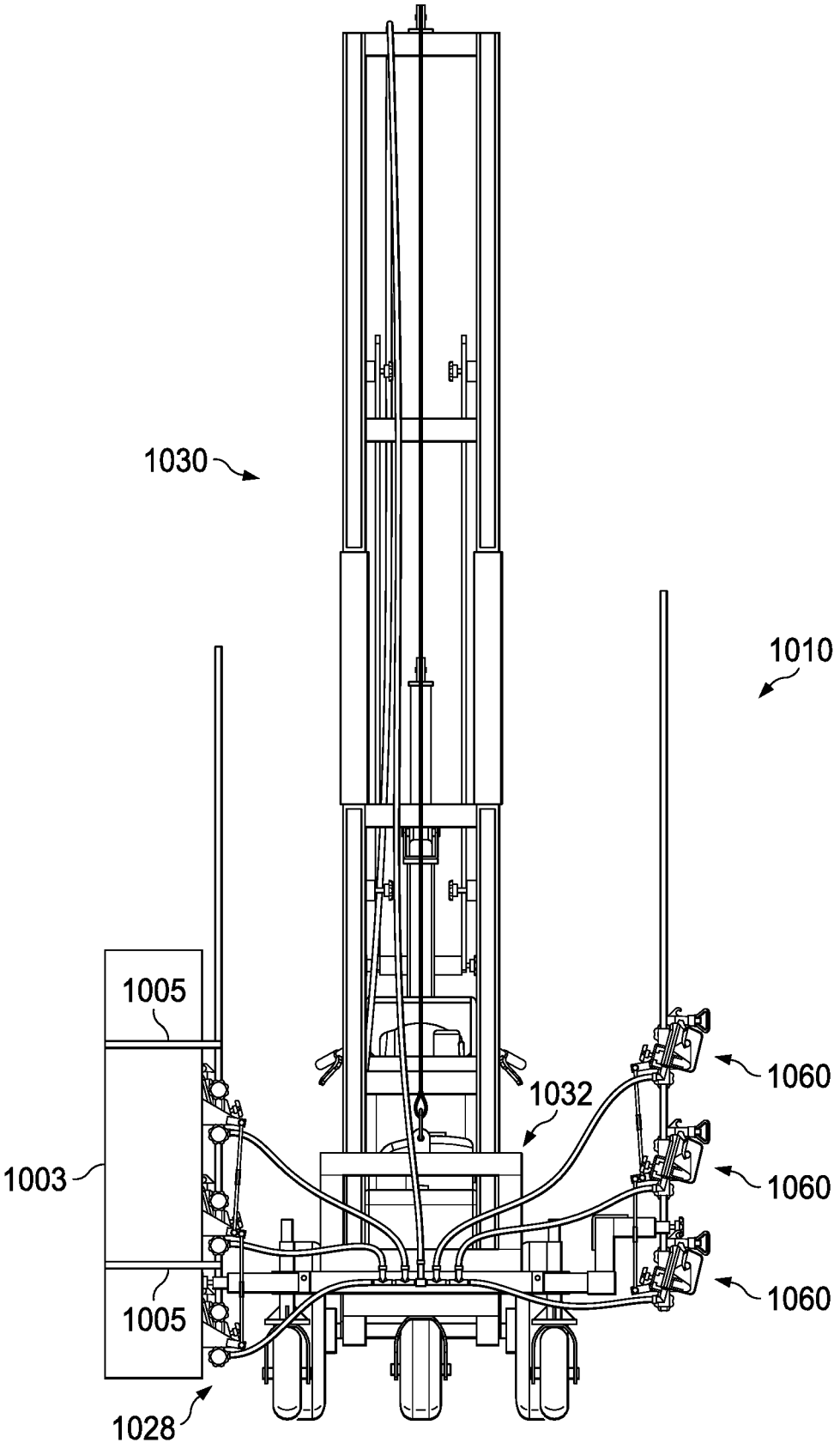
FIG. 17 is a front view depicting the system of FIG. 16.

FIGS. 16 and 17 illustrate a system 1010 that is similar to, or the same in many respects as, the systems 10 and 210 of FIGS. 1-4 and 5, respectively. For example, the system 1010 can include a lift structure 1028. The lift structure 1028 can include a mast 1030 and a carriage 1032 that is vertically slidable on the mast 1030. A plurality of right spray heads 1058 can be coupled with the carriage 1032 and arranged vertically. However, the system 1010 can include an overspray shield 1003 that is coupled with the carriage 1032 via a pair of frame members 1005 and is disposed in front of the right spray heads 1058. The overspray shield 1003 can extend vertically along the right spray heads 1058 to prevent at least some overspray of the fluid dispensed from the right spray heads 1058 from reaching an area in front of the overspray shield 1003. The overspray shield 1003 can additionally or alternatively be disposed rearwardly of the right spray heads 1058 to prevent at least some of the fluid dispensed from the right spray heads 1058 from overspraying onto an area that is rearward of the overspray shield 1003. In one embodiment, the frame members 1005 can be selectively repositioned to allow the overspray shield 1003 to be disposed rearwardly of the right spray heads 1058. It is to be appreciated that an overspray shield can additionally or alternatively be provided along the left spray heads 1060 in a similar manner as described with respect to the right spray heads 1058.

It is to be appreciated that other surface treatment devices are contemplated for treating a surface with the wheeled cart, in accordance with the principles and methods of the present disclosure. For example, in one embodiment, the surface treatment device can comprise a joint repair tool (not shown) that is coupled with a carriage (e.g., 32) of a wheeled cart (e.g., 12). The joint sealing tool can comprise a blade and a sealant applicator. The blade can be configured to clean a horizontal joint such as a control joint or a joint located between a wall and a floor. The blade can a rotating blade, a flat stationary blade, or any of a variety of suitable alternative blades. The sealant applicator can be configured to apply sealant to the joint after it has been cleaned. In one embodiment, the sealant applicator can be a spray head. The blade and the sealant applicator can be arranged substantially horizontally with the blade positioned in front of the applicator (e.g., closer to a front end of the wheeled vehicle). When the joint sealing tool engages the horizontal joint and the wheeled cart is driven along the wall, the horizontal joint is first cleaned by the blade and the sealant applicator applies a sealant to the cleaned joint. In one embodiment, a vacuum duct (not shown) can be associated with the blade and configured to facilitate extraction of at least some of the dust or debris that is removed from the joint. The joint sealing tool can remove debris from a horizontal joint and apply a sealant more efficiently and faster than conventional manual methods.

In another embodiment, the surface treatment device can comprise a joint repair tool (not shown) that is coupled with a carriage (e.g., 32) of a wheeled cart (e.g., 12). The joint repair tool can comprise a saw blade, a sand applicator, a joint compound applicator, a heat source, and a scraping device. The saw blade can be configured to dredge an existing horizontal joint on a vertical structure (e.g., a wall) to remove debris from the horizontal joint. The blade can a rotating blade, a flat stationary blade, or any of a variety of suitable alternative blades. In one embodiment, a vacuum duct (not shown) can be associated with the blade and configured to facilitate extraction of at least some of the dust or debris that is dredged from the horizontal joint. The sand applicator can be configured to apply sand to the dredged joint after the blade has removed the debris from the joint. In one embodiment, the sand applicator can be spray head. The joint compound applicator can be configured to apply a joint compound (e.g., epoxy or polyurea) to the sanded joint. In one embodiment, the joint compound applicator can comprise a powered caulking gun. The heat source can be configured to apply heat to the joint compound provided in the sanded joint. In one embodiment, the heat source can comprise a blow torch. The scraping device can be configured to scrape excess heated joint compound from the horizontal joint. In one embodiment, the scraping device can comprise a blade. The saw blade, the sand applicator, the joint compound applicator, the heat source, and the scraping device can be arranged substantially horizontally on the carriage and in order such that the saw blade is located at a frontmost position and the scraper is located at a rearmost position. When the joint repair tool engages a horizontal joint on wall and the wheeled cart is driven along the wall, the horizontal joint is first cleaned by the saw blade and the sand applicator applies sand to the cleaned joint. The joint compound applicator then applies joint compound to the sanded joint and the heat source heats the joint compound in the horizontal joint. The scraper then scrapes the excess joint compound from the horizontal joint. The joint repair tool can prepare, fill and finish a wall joint faster, more efficiently, and more effectively than conventional manual methods.

The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. The scope of the disclosure is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A system for treating a surface, the system comprising:

a wheeled vehicle comprising:

a frame;

an operator steering interface supported by the frame; and a plurality of powered drive wheels rotatably coupled with the frame, wherein at least one of the powered drive wheels is pivotable to facilitate steering of the wheeled vehicle in real time response to an operator's interaction with the operator steering interface;

a lift structure coupled with the frame, the lift structure comprising:

a mast;

a carriage slidably coupled with the mast and movable between a first position and a second position; and a plurality of spray heads coupled with the carriage and arranged in a vertical line;

a pump in fluid communication with the plurality of spray heads and configured to distribute fluid to the plurality of spray heads;

a controller;

a first proximity sensor located on the frame and configured to provide feedback data to the controller during operation of the system;

a second proximity sensor located on the mast and configured to provide feedback data to the controller during operation of the system; and a third proximity sensor located on the carriage and configured to provide feedback data to the controller during operation of the system; wherein the controller is configured to operate the plurality of powered drive wheels and the plurality of spray heads in response to the feedback data from each of the first proximity sensor, the second proximity sensor, and the third proximity sensor.

2. The system of claim 1 wherein the first position is a raised position and the second position is a lowered position.

3. The system of claim 1 wherein at least one of the first proximity sensor, the second proximity sensor, and the third proximity sensor comprises an infrared sensor, and wherein the controller is configured to facilitate autonomous operation of the system in response to the feedback data from each of the first proximity sensor, the second proximity sensor, and the third proximity sensor.

* * * * *